US009100736B2

(12) United States Patent
Jensen et al.

(10) Patent No.: US 9,100,736 B2
(45) Date of Patent: Aug. 4, 2015

(54) CONTROL OF AN ADAPTIVE FEEDBACK CANCELLATION SYSTEM BASED ON PROBE SIGNAL INJECTION

(71) Applicant: OTICON A/S, Smørum (DK)

(72) Inventors: Jesper Jensen, Smørum (DK); Meng Guo, Smørum (DK)

(73) Assignee: OTICON A/S, Smorum (DK)

( * ) Notice: Subject to any disclaimer, the term of this patent is extended or adjusted under 35 U.S.C. 154(b) by 330 days.

(21) Appl. No.: 13/622,880

(22) Filed: Sep. 19, 2012

(65) Prior Publication Data

US 2013/0070936 A1 Mar. 21, 2013

Related U.S. Application Data

(60) Provisional application No. 61/536,593, filed on Sep. 20, 2011.

(30) Foreign Application Priority Data

Sep. 20, 2011 (EP) ..... 11181909

(51) Int. Cl.

| | |
|---|---|
| ***H04B 15/00*** | (2006.01) |
| ***H04M 9/08*** | (2006.01) |
| ***H04R 3/02*** | (2006.01) |
| ***H04R 3/00*** | (2006.01) |
| *H04R 25/00* | (2006.01) |
| *H04R 27/00* | (2006.01) |

(52) U.S. Cl.

CPC ..... *H04R 3/02* (2013.01); *H04R 3/005* (2013.01); *H04R 25/453* (2013.01); *H04R 25/407* (2013.01); *H04R 27/00* (2013.01)

(58) Field of Classification Search

None

See application file for complete search history.

(56) References Cited

FOREIGN PATENT DOCUMENTS

EP 2237573 * 10/2010

OTHER PUBLICATIONS

Guo et al., "Comparison of Multiple-Microphone and Single Loudspeaker Adaptive Feedback/Echo Cancellation Systems", Aug. 29, 2011.*

Guo et al. "Analysis of Adaptive Feedback and Echo Cancellation Algorithms in a General Multiple-Microphone and Single Loudspeaker System", May 22, 2011.*

* cited by examiner

*Primary Examiner* — Regina N Holder

(74) *Attorney, Agent, or Firm* — Birch, Stewart, Kolasch & Birch, LLP

(57) ABSTRACT

Method and audio processing system determine a system parameter sp in a gain loop of an audio processing system. An alternative scheme is provided for feedback estimation in a multi-microphone audio processing system comprising an injected probe signal. The problem is solved in that a) an expression of an approximation of the expected square of the stationary loop gain, $LG_{stat}(\omega,n)$, and b) an expression of the convergence or decay rate of the expected square of the stationary loop gain, $LG_{stat}(\omega,n)$, after an abrupt change in one or more system parameters are determined, and in that c) a system parameter sp is determined from one of said expressions under the assumption that other system parameters are fixed. The method has the advantage of providing a relatively simple way of identifying and controlling dynamic changes in the acoustic feedback path(s).

19 Claims, 6 Drawing Sheets

CONTROL OF AN ADAPTIVE FEEDBACK CANCELLATION SYSTEM BASED ON PROBE SIGNAL INJECTION

TECHNICAL FIELD

The present disclosure relates to the area of audio processing, e.g. acoustic feedback cancellation in audio processing systems exhibiting acoustic or mechanical feedback from a loudspeaker to a microphone, as e.g. experienced in public address systems or listening devices, e.g. hearing aids. The disclosure relates specifically to a method of determining a system parameter sp in a gain loop of an audio processing system and to an audio processing system.

The application further relates to a data processing system comprising a processor and program code means for causing the processor to perform at least some of the steps of the method.

The disclosure may e.g. be useful in applications such as hearing aids, headsets, ear phones, active ear protection systems, handsfree telephone systems, mobile telephones, teleconferencing systems, security systems, public address systems, karaoke systems, classroom amplification systems, etc.

BACKGROUND

Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem typically appears when the microphone and the loudspeaker are placed closely together, as e.g. in hearing aids. Some other typical situations with feedback problems are telephony, public address systems, headsets, audio conference systems, etc.

EP 2237573 A1 deals with adaptive feedback cancellation in an audio processing system, e.g. a listening device where specific characteristic properties in an output signal of the forward path are introduced and/or identified. A signal comprising the identified or introduced properties is propagated through the feedback path from output to input transducer and extracted or enhanced on the input side in an Enhancement unit matching (in agreement between the involved units) the introduced and/or identified specific characteristic properties. The signals comprising the specific characteristic properties on the input and output sides, respectively, (i.e. before and after having propagated through the feedback path) are used to estimate the feedback path transfer function in a feedback estimation unit.

SUMMARY

An object of the present application is to provide an alternative scheme for feedback estimation in a multi-microphone audio processing system comprising an injected probe signal.

Objects of the application are achieved by the invention described in the accompanying claims and as described in the following.

A method of Determining a System Parameter in a Gain Loop of an Audio Processing System:

In an aspect of the present application, an object of the application is achieved by A method of determining a system parameter sp in a gain loop of an audio processing system, the audio processing system comprising a) a microphone system comprising a1) a number P of electric microphone paths, each microphone path $MP_i$, i=1, 2, . . . , P, providing a processed microphone signal, each microphone path comprising a1.1) a microphone $M_i$ for converting an input sound comprising a target signal $x_i$ to an electric signal $y_i$;

a1.2) a unit $SUM_i$ for providing a summation of a signal of the microphone path $MP_i$ and a further signal providing error signal $e_i$;

a1.3) a beamformer filter $g_i$ for performing spatial filtering of an input signal of the microphone path $MP_i$ to obtain a noise-reduced signal $e_i$; wherein the microphone $M_i$, the summation unit $SUM_i$ and the beamformer filter $g_i$ are operationally connected in series to provide said processed microphone signal equal to said noise-reduced signal $\bar{e}_i$ or a signal originating therefrom; and a2) a summation unit $SUM_{1-p}$ connected to the output of the microphone paths i=1, 2, . . . , P, to perform a summation of said processed microphone signals thereby providing a resulting input signal;

b) a signal processing unit for applying a, generally time-varying, frequency dependent gain G to said resulting input signal or a signal originating therefrom to a processed signal;

c) a probe signal generator for inserting a probe signal w in the forward path, the probe signal exhibiting predefined properties and having a short-time power spectral density $S_w(\omega)$;

d) a loudspeaker unit for converting said processed signal or a signal originating therefrom u to an output sound;

said microphone system, said signal processing unit and said loudspeaker unit forming part of a forward signal path;

e) an adaptive feedback estimation system comprising a number of internal feedback paths $IFBP_i$, i=1, 2, . . . , P, for generating an estimate of a number P of unintended feedback paths, each unintended feedback path at least comprising an external feedback path from the output of the loudspeaker unit to the input of a microphone $M_i$, i=1, 2, . . . , P, and each internal feedback path comprising a feedback estimation unit comprising a feedback compensation filter of length L samples for providing an estimated impulse response $\hat{h}_i$ of the $i^{th}$ unintended feedback path, i=1, 2, . . . , P, using an adaptive estimation algorithm, e.g. an least mean square (LMS) algorithm or normalized least mean square (NLMS), or other adaptive algorithms, the estimated impulse response $\hat{h}_i$ being subtracted from a signal from the $i^{th}$ microphone path $MP_i$ in respective of said summation units $SUM_i$ of said microphone system to provide said error signals $e_h$, i=1, 2, . . . , P, the adaptive estimation algorithm comprising an adaptation parameter μ for controlling an adaptation speed of the adaptive algorithm relating a current feedback estimate to a previous feedback estimate;

the forward signal path, together with said external and internal feedback paths defining said gain loop, the method comprising S1a) determining an expression of an approximation of the expected square of the stationary loop gain, LGstat(ω,n), where ω is normalized angular frequency, and n is a discrete time index, the expression being dependent on said frequency dependent gain G, a dimension L of said feedback compensation filters, said adaptation parameter μ for the adaptive algorithm and an expression $$\sum_i \sum_j G_j^*(\omega) G_i(\omega) S_{xij}(\omega)$$

wherein Gi(ω) and Gj(ω) are the frequency transform of the ith and jth beamform filters, respectively, * denotes the complex conjugate, and Sxij(ω) is the cross-power spectral density of the signals xi(n) and xj(n) picked up by microphones i and j respectively, where i=1, 2, . . . , P and j=1, 2, . . . , P, and wherein the expression LGstat(ω,n) for stationary loop gain represents an asymptotic value for n→∞; or S1b) determining an expression of the convergence or decay rate of the expected square of the stationary loop gain, LGstat(ω,n), after an abrupt change in one or more system parameters, the expression being dependent on said adaptation parameter μ for the adaptive algorithm and the power spectral density Sw(ω) of the probe signal;

S2) determining a system parameter sp, from one of said expressions under the assumption that other system parameters are fixed.

The method has the advantage of providing a relatively simple way of identifying and controlling dynamic changes in the acoustic feedback path(s).

The term 'beamformer' refers in general to a spatial filtering of an input signal, the 'beamformer' providing a frequency dependent filtering depending on the spatial direction of origin of an acoustic source (directional filtering). In a portable listening device application, e.g. a hearing aid, it is often advantageous to attenuate signals or signal components having their spatial origin in a direction to the rear of the person wearing the listening device.

The inclusion of the contribution of the beamformer in the estimate of the feedback path is important because of its angle dependent attenuation (i.e. because of its weighting of the contributions of each individual microphone input signal to the resulting signal being further processed in the device in question). Taking into account the presence of the beamformer results in a relatively simple expression that is directly related to the OLTF and the allowable forward gain.

The signal processing (and the illustrations) is generally described to be performed in the time domain. This need not be the case, however. It can be fully or partially performed in the frequency domain. The beamformer filters $g_i$ (see e.g. FIG. 3*b*), for example, each represent an impulse response in the time domain, so the input signal ($e_i(n)$ in FIG. 3*b*) to a given filter $g_i$ is linearly convolved with the impulse response $g_i$ to form the output signal ($\bar{e}_i(n)$ in FIG. 3*b*). Alternatively, in the frequency domain the input signal in each microphone branch is transformed to the frequency domain, e.g. via an FFT or an analysis filterbank, and the frequency transform $G_i(\omega)$ of the beamformer impulse response $g_i$ would be multiplied with the frequency transform of the input signal, to form the processed signal $\hat{E}i(\omega)$, which is the frequency transform of the time-domain output signal of the beamformer ( $\bar{e}_i(n)$. Staying in the frequency domain, the forward gain (G(n) in the FIG. 3*b*), would be implemented by multiplying a scalar gain G(ω,n) onto each frequency of the beamformer output. At some point (e.g. after the gain block G(ω,n), as illustrated in FIG. 3*c*), the signal is transformed back to the time domain, e.g. via an inverse FFT (or a synthesis filter bank), so that a time-domain signal u(n) (or $u_w(n)$) can be played back through the loudspeaker.

In an embodiment, the short-time power spectral density $S_w(\omega)$ of the probe signal is assumed constant across a certain period of time, but in practice is time-varying. Preferably, the time variation in power spectral density $S_w(\omega)$ of the probe signal is related to the type of the signal that processed in the forward path of the audio processing system, e.g. speech, music, etc. Preferably, the time variation in power spectral density $S_w(\omega)$ of the probe signal is related to the time variation of the signal that processed in the forward path of the audio processing system. In an embodiment, where the currently processed signal of the forward path of the audio processing system is speech, the short-time power spectral density $S_w(\omega)$ of the probe signal is assumed constant over a time period of the order of 10 ms to 20 ms. Preferably the short-time power spectral density $S_w(\omega)$ of the probe signal is adapted to ensure that it is inaudible to the user.

In a preferred embodiment, the internal feedback paths $IFBP_i$, i=1, 2, . . . , P, of the adaptive feedback estimation system further comprises an enhancement filter $a_i$ operating on the feedback compensated signals $e_i(n)$, i=1, 2, . . . , P, of the forward path and being adapted to retrieve said predefined properties of said probe signal and providing an enhanced error signal $\tilde{e}_i(n)$ connected to the feedback estimation unit of the $i^{th}$ internal feedback path $IFBP_i$.

In an embodiment, the enhancement filters $a_i$, i=1, 2, . . . , P, have a transfer function of the form:

$$A(\omega) = 1 + \sum_{k=D}^{L_a-1} a(k) e^{-j\omega k}$$

where $L_a$ is the dimension of the enhancement filter, D is chosen to satisfy D>0, k is a sample index, and a(k) the filter coefficients, and wherein in step S1a) said expression of an approximation of the expected square of the stationary loop gain, $LG_{stat}(\omega,n)$, is further dependent on the square of the magnitude of the transfer function A(ω) of the enhancement filter. Preferably $D>L+L_w-1$, where L is the dimension of the feedback compensation filters $\hat{h}_i$, and where $L_w$ is the correlation time in samples of the added probe signal w(n).

In an embodiment, the internal feedback paths $IFBP_i$, i=1, 2, . . . , P, of the adaptive feedback estimation system further comprises an enhancement filter $a_i$ operating on the probe signal w(n) and being adapted to retrieve said predefined properties of said probe signal and providing an enhanced probe signal $\tilde{w}_i(n)$ connected to the feedback estimation unit of the $i^{th}$ internal feedback path $IFBP_i$.

In an embodiment, the enhancement filters $a_i$, i=1, 2, . . . , P, have a transfer function of the form:

$$A(\omega) = 1 + \sum_{k=D}^{L_a-1} a(k) e^{-j\omega k}$$

where $L_a$ is the dimension of the enhancement filter, D is chosen to satisfy D>0, and k is a sample index, and a(k) the filter coefficients, and wherein in step S1a) said expression of an approximation of the expected square of the stationary loop gain, $LG_{stat}(\omega,n)$, is further dependent on the square of the magnitude of the transfer function A(ω) of the enhancement filter; and in step S1b) said expression of the convergence or decay rate of the expected square of the stationary loop gain, $LG_{stat}(\omega,n)$, is further dependent on $A_0(\omega)$ as the discrete Fourier transform of the sequence [0 . . . 0 a(D) a(D+1). . . a($L_a$−1)], evaluated at the angular frequency ω.

Preferably $D>L+L_w-1$, where L is the dimension of the feedback compensation filters $\hat{h}_i$, and where $L_w$ is the correlation time in samples of the added probe signal w(n). The dimension of the sequence is $[1, L_a]$, i.e. 1 row and $L_a$ columns.

In an embodiment, the adaptive feedback estimation algorithm is $$\hat{h}_i(n)=\hat{h}_i(n-1)+\mu(n)w(n)e_i(n),\ i=1,\ldots,P,$$

where $\hat{h}_i$ is the estimated impulse response of the $i^{th}$ unintended feedback path, μ is the adaptation parameter, w the probe signal and $e_i$ the error signal of the forward path, n a time instance, and i=1, 2, . . . , P. In an embodiment, the adaptive feedback estimation algorithm is an LMS algorithm.

In an embodiment, the adaptive feedback estimation algorithm is $$\hat{h}_i(n)=\hat{h}_i(n-1)+\mu(n)w(n)\tilde{e}_i(n),\ i=1,\ldots,P,$$

where $\hat{h}_i$ is the estimated impulse response of the $i^{th}$ unintended feedback path, μ is the adaptation parameter, w the probe signal, $\tilde{e}_i$ the enhanced error signal, n a time instance, and i=1, 2, . . . , P.

In an embodiment, the adaptive feedback estimation algorithm is $$\hat{h}_i(n)=\hat{h}_i(n-1)+\mu(n)\tilde{w}_i(n)\tilde{e}_i(n),i=1,\ldots,P,$$

where $\hat{h}_i$ is the estimated impulse response of the $i^{th}$ unintended feedback path, μ is the adaptation parameter, w the probe signal, $\tilde{w}_i(n)$ the enhanced probe signal, n a time instance, and i=1, 2, . . . , P.

In an embodiment, the cross-power spectral density $S_{xij}(\omega)$ of the signals $x_i(n)$ and $x_j(n)$ picked up by microphones i and j, respectively, is estimated by the cross-power spectral density of the respective error signals $e_j(n)$ and $e_j(n)$.

In an embodiment, the asymptotic value for $n\rightarrow\infty$ of the expression for stationary loop gain $LG_{stat}(\omega,n)$ is assumed to be reached after less than 500 ms, such as less than 100 ms, such as less than 50 ms.

In an embodiment, the system parameter sp determined in step S2 under the assumption that other system parameters (e.g. all other) are fixed at desired values is the adaptation parameter μ(n) of the adaptive algorithm or the gain G(n) of the signal processing unit.

In an embodiment, the other system parameters being fixed at a desired value in step S2 comprise one or more of the stationary loop gain $LG_{stat}(\omega,n)$ and the adaptation rate Δ(ω) at a given angular frequency ω.

In an embodiment, a predetermined desired value of stationary loop gain $LG_{stat}(\omega,n)$ at a given angular frequency ω is used in step S1a to determine a corresponding value of the adaptation parameter μ of the adaptive algorithm at a given point in time and at the given angular frequency ω.

In an embodiment, a predetermined desired value Δ* of the convergence rate Δ of the expected square of the stationary loop gain $LG_{stat}(\omega,n)$ at a given angular frequency ω is used in step S1b to determine a corresponding value of the adaptation parameter μ of the adaptive algorithm at a given point in time and at the given angular frequency ω.

In an embodiment, an angular frequency ω at which the system parameter sp is determined in step S2 is chosen as a frequency where stationary loop gain $LG_{stat}(\omega,n)$, is maximum or larger than a predefined value.

In an embodiment, an angular frequency ω at which the system parameter sp is determined in step S2 is chosen as a frequency where instantaneous loop gain $LG_{stat}(\omega,n)$ is expected to be maximum or larger than a predefined value.

In an embodiment, an angular frequency ω at which the system parameter sp is determined in step S2 is chosen as a frequency where the gain G(n) of the signal processing unit is highest, or where the gain G(n) of the signal processing unit has experienced the largest recent increase, e.g. within the last 50 ms.

An Audio Processing System:

In an aspect, An audio processing system comprising a) a microphone system comprising a1) a number P of electric microphone paths, each microphone path MPi, i=1, 2, . . . , P, providing a processed microphone signal, each microphone path comprising a1.1) a microphone Mi for converting an input sound comprising a target signal xi to an electric signal yi;

a1.2) a unit SUMi for providing a summation of a signal of the microphone path MPi and a further signal providing error signal ei;

a1.3) a beamformer filter gi for performing spatial filtering of an input signal of the microphone path MPi to obtain a noise-reduced signal $\bar{e}i$;

wherein the microphone Mi, the summation unit SUMi and the beamformer filter gi are operationally connected in series to provide said processed microphone signal equal to said noise-reduced signal $\bar{e}i$ or a signal originating therefrom; and a2) a summation unit SUM1-P connected to the output of the microphone paths i=1, 2, . . . , P, to perform a summation of said processed microphone signals thereby providing a resulting input signal;

b) a signal processing unit for applying a frequency dependent gain G to said resulting input signal or a signal originating therefrom to a processed signal;

c) a probe signal generator for inserting a probe signal w in the forward path, the probe signal exhibiting predefined properties and having a power spectral density Sw(ω);

d) a loudspeaker unit for converting said processed signal or a signal originating therefrom u to an output sound;

said microphone system, said signal processing unit and said loudspeaker unit forming part of a forward signal path;

e) an adaptive feedback estimation system comprising a number of internal feedback paths IFBPi, i=1, 2, . . . , P, for generating an estimate of a number P of unintended feedback paths, each unintended feedback path at least comprising an external feedback path from the output of the loudspeaker unit to the input of a microphone Mi, i=1, 2, . . . , P, and each internal feedback path comprising a feedback estimation unit comprising a feedback compensation filter of length L for providing an estimated impulse response $\hat{h}i$ of the ith unintended feedback path, i=1, 2, . . . , P, using an adaptive feedback estimation algorithm, the estimated impulse response $\hat{h}i$ being subtracted from a signal from the ith microphone path MPi in respective of said summation units SUMi of said microphone system to provide said error signals ei, i=1, 2, . . . , P, the adaptive feedback estimation algorithm comprising an adaptation parameter μ for controlling an adaptation speed of the adaptive algorithm relating a current feedback estimate to a previous feedback estimate;

the forward signal path, together with said external and internal feedback paths defining said gain loop is furthermore provided by the present application. The audio processing system further comprises a control unit adapted to perform the steps of the method of any one of claims 1-17.

It is intended that the process features of the method described above, in the 'detailed description of embodiments' and in the claims can be combined with the system, when appropriately substituted by a corresponding structural features and vice versa. Embodiments of the system have the same advantages as the corresponding method.

In an embodiment, the audio processing system is adapted to provide a frequency dependent gain to compensate for a hearing loss of a user. In an embodiment, the listening device comprises a signal processing unit for enhancing the input signals and providing a processed output signal. Various aspects of digital hearing aids are described in [Schaub].

In an embodiment, the microphone system of the audio processing system is adapted to detect (such as adaptively detect) from which direction a particular part of the microphone signal originates. This can be achieved in various different ways as e.g. described in U.S. Pat. No. 5,473,701 or in WO 99/09786 A1 or in EP 2 088 802 A1.

In an embodiment, the audio processing system comprises an antenna and transceiver circuitry for wirelessly receiving a direct electric input signal from another device, e.g. a communication device or another audio processing system.

In an embodiment, the audio processing system comprises (or constitutes) one or more (e.g. two) portable device, e.g. a device comprising a local energy source, e.g. a battery, e.g. a rechargeable battery.

In an embodiment, the audio processing system comprises a forward or signal path between the microphone system (and/or a direct electric input, e.g. a wireless receiver) and the loudspeaker. In an embodiment, the signal processing unit is located in the forward path. In an embodiment, the audio processing system comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_o$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audi samples are arranged in a time frame. In an embodiment, a time frame comprises 64 audio data samples. Other frame lengths may be used depending on the practical application.

In an embodiment, the audio processing systems comprise an analogue-to-digital (AD) converter to digitize an analogue input with a predefined sampling rate, e.g. 20 kHz. In an embodiment, the audio processing systems comprise a digital-to-analogue (DA) converter to convert a digital signal to an analogue output signal, e.g. for being presented to a user via an output transducer.

In an embodiment, the audio processing system, e.g. the microphone unit (and or the transceiver unit) comprises a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the audio processing system from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, the frequency range $f_{min}$-$f_{max}$ considered by the audio processing system is split into a number M of frequency bands, where M is e.g. larger than 5, such as larger than 10, such as larger than 50, such as larger than 100, at least some of which are processed individually. In an embodiment, the audio processing system is/are adapted to process their input signals in a number of different frequency ranges or bands. The frequency bands may be uniform or non-uniform in width (e.g. increasing in width with frequency), overlapping or non-overlapping.

In an embodiment, the audio processing system further comprises other relevant functionality for the application in question, e.g. compression, noise reduction, etc.

In an embodiment, the audio processing system comprises a hearing aid, e.g. a hearing instrument, e.g. a hearing instrument adapted for being located at the ear or fully or partially in the ear canal of a user, e.g. a headset, an earphone, an ear protection device or a combination thereof. In an embodiment, the audio processing system comprises a handsfree telephone system, a mobile telephone, a teleconferencing system, a security system, a public address system, a karaoke system, a classroom amplification systems or a combination thereof.

Use:

In an aspect, use of an audio processing system as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, the computer program can also be transmitted via a transmission medium such as -a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference numerals are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Figure 1:
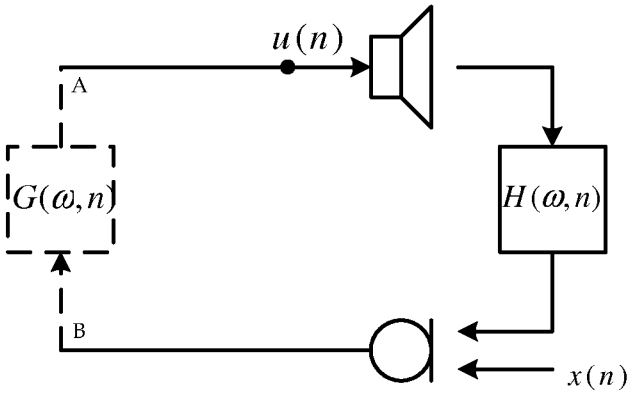
FIG. 1 shows basic elements of a closed-loop audio processing system.

FIG. 1 shows basic elements of a general audio processing system where the input signal x(n) is amplified via the amplification block G(ω,n) to form the output signal u(n), which is played back through the loudspeaker. The acoustic coupling of the loud speaker signal back to the microphone is represented as the transfer function H(ω,n). Thus, the concatenation of transfer functions G(ω,n) and H(ω,n) forms a loop, and the system can potentially be unstable. The stability of such systems with a feedback loop can be determined according to the Nyquist criterion, by the open loop transfer function (OLTF): the system is unstable whenever the magnitude of the OLTF, which is called the open loop gain (LG), is above 1 (0 dB) and the phase is a multiple of 360° (2π) at least at one frequency. In the general system depicted in FIG. 1, the (complex-valued) OLTF is given by $$\mathrm{OLTF}(\omega,n)=G(\omega,n)H(\omega,n),$$

and $$\mathrm{LG}(\omega,n)=|\mathrm{OLTF}(\omega,n)|.$$

Thus, generally speaking, the OLTF or the LG is of interest for determining the behavior of closed-loop systems, since it expresses clearly and directly at which frequencies feedback problems (are about to) occur.

The OLTF and LG constitute direct criteria for studying the stability of hearing aids and the capability of providing appropriate gains (cf. e.g. [Dillon] chapter 4.6). In a hearing aid setup, the forward signal path, G(ω,n) is part of the hearing aid and therefore known, while the feedback path H(ω,n) is unknown. Thus, for example, when |H(ω,n)| is −20 dB, then the maximum gain |G(ω)| provided by the forward path of the hearing aid must not exceed 20 dB; if it does, LG(ω,n) exceeds 0 dB, and the system may be unstable. On the other hand, if LG(ω,n) is approaching 0 dB, then the hearing aid is approaching instability at the frequencies, where the phase response is a multiple of 360°, and actions are needed to prevent oscillations and/or an increased amount of artifacts.

Traditionally, design and evaluation criteria such as mean-squared error, squared error deviation and variants of these are widely used in the design and evaluation of adaptive systems. Unfortunately, none of these are directly related to the OLTF or LG, and therefore only express rather indirectly the state or performance of algorithms for reducing the feedback problem.

Figure 2:
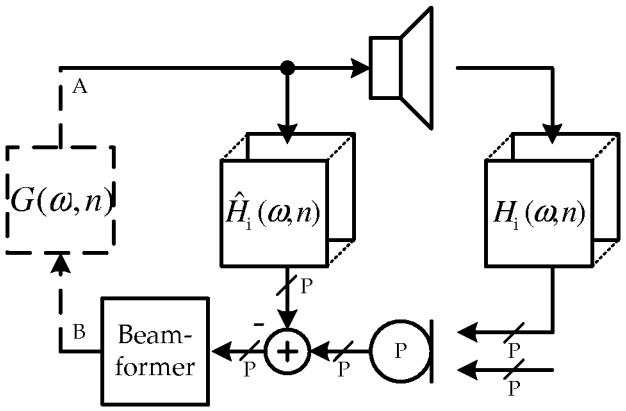
FIG. 2 shows basic elements of a closed-loop audio processing system with feedback cancellation based on adaptive filtering.

The most widely used and probably best solution to date for reducing the effect of this feedback problem consists of identifying the acoustic feedback transfer function by means of an adaptive filter [Haykin]. FIG. 2 shows this principle, where an estimated feedback path transfer function $\hat{H}(\omega,n)$ is used for reducing the feedback signal received at the microphone. In the ideal case where the estimate is perfect, $\hat{H}(\omega,n)=H(\omega,n)$, the feedback is completely eliminated. FIG. 2 shows a model of an audio processing system comprising a microphone and a speaker. The target (or additional) acoustic signal input to the microphone is indicated by the lower arrow. The audio processing system further comprises an adaptive algorithm $\hat{H}(\omega,n)$ for estimating the feedback transfer function H(ω,n). The feedback estimate unit $\hat{H}(\omega,n)$ is connected between the speaker and a sum-unit ('+') for subtracting the feedback estimate from the input microphone signal. The resulting feedback-corrected (error) signal is fed to a signal processing unit G(ω,n) for further processing the signal (e.g. applying a frequency dependent gain according to a user's needs), whose output is connected to the speaker and feedback estimate unit $\hat{H}(\omega,n)$. The signal processing unit G(ω,n) and its input (B) and output (A) are indicated by a dashed (out)line to indicate the elements of the system which are in focus in the present application, namely the elements, which together represent the feedback part of the open loop transfer function of the audio processing system (i.e. the parts indicated with a solid (out)line. The system of FIG. 2 can be viewed as a model of a one speaker—one microphone audio processing system, e.g. a hearing instrument.

Figure 3A:
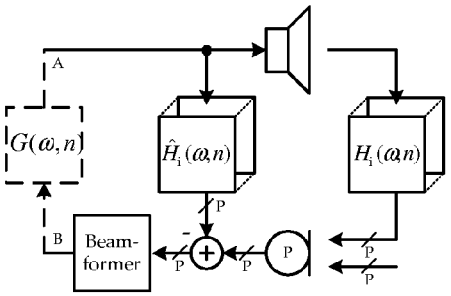
FIGS. 3*a*, 3*b* and 3*c* show three embodiments of a P-Microphone Single-Loudspeaker audio processing system with feedback cancellation based on adaptive filtering.

FIG. 3*a* generalizes the description to an audio processing system with P microphones instead of one. In this case, there are P feedback transfer functions $H_i(\omega,n)$, i=1, . . . , P, (one from the loudspeaker to each microphone), and thus P feedback cancellation filters $\hat{H}_i(\omega,n)$, i=1, . . . P. In this case, the system includes a beamforming algorithm, since multi-microphone systems (P>1), allow for spatial filtering to reduce the noise level in the incoming signals. The Beamformer block receives the P feedback corrected inputs from the P SUM-units (Y) and supplies a frequency-dependent, directionally filtered (and feedback corrected) input signal to the signal processing unit $G(\omega,n)$ for further processing the signal. This is shown in further detail in FIG. 3*b*.

Figure 3C:
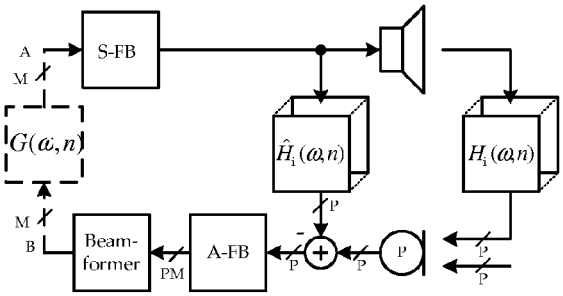
Figure 3B:
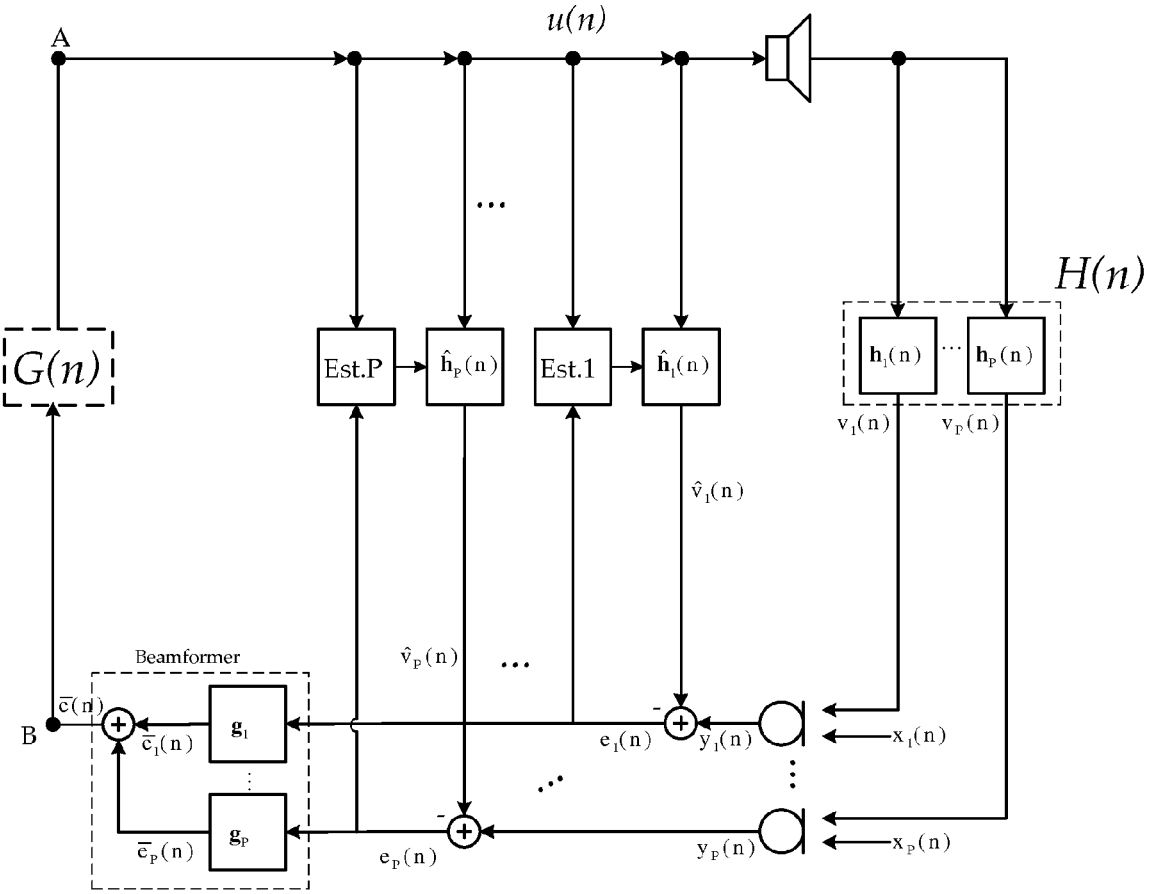

FIG. 3*b* depicts an audio processing system as in FIG. 3*a*, but here assumed to be a hearing aid system (and shown with one loudspeaker and P microphones) with a traditional feedback cancellation algorithm based on adaptive filtering. An output signal u(n) is presented for the user of the system via the loudspeaker. Unfortunately, the loudspeaker signal leaks back to the microphones, e.g. via the vent of a hearing aid, residual ear canal passages, or simply via the ear canal for open fittings. The transfer function (or impulse response) from the loudspeaker to each microphone is denoted as $h_i(n)$, i=1, . . . , P. The ith microphone picks up target signal $x_i(n)$ to form the observed microphone signal $y_i(n)$. Feedback cancellation is performed by subtracting from $y_i(n)$ the loudspeaker signal u(n) filtered through an estimate $\hat{h}_i(n)$ of the transfer function from the loudspeaker to the ith microphone. The feedback path estimate $\hat{h}_i(n)$ is obtained via any of a set of well-known adaptive algorithms, including the (normalized) least mean square ((N)LMS) algorithm, the recursive least square (RLS) algorithm, the affine project algorithm (APA), etc., see [Haykin]. The adaptive algorithm in question is implemented in estimation blocks Est.i, i=1, 2, . . . , P, which feed update filter coefficients to variable filter blocks $h_i(n)$, i=1, 2, . . . , P. The estimation blocks receive inputs from the forward path, here output signal u(n) and error corrected input signal $e_i(n)$, i=1, 2, . . . , P. The adaptive algorithms of blocks Est.i are preferably identical. Further, the dimension L of the variable filter blocks $h_i(n)$ are preferably identical. The feedback compensated microphone signals $e_i(n)$, i=1, . . . , P are used as input to a beamformer algorithm $g_i$, i=1, 2, . . . , P, e.g., the multi-channel Wiener filter [Bitzer & Simmer], which performs spatial filtering to obtain a noise-reduced signal $\bar{e}(n)$. Preferably, the dimensions $L_a$ of the beamformer filters are identical. This noise-reduced signal is passed through a forward path represented by the time-varying transfer function G(n), which incorporates a time- and frequency-dependent amplification, to form the loud speaker signal u(n). The traditional feedback cancellation strategy depicted in FIG. 3 suffers from a well-known problem: When the incoming signals $x_1(n)$, . . . , $x_p(n)$ are correlated with the loudspeaker signal u(n), a situation which occurs frequently in practice, the estimates $\hat{h}_1(n)$, . . . , $\hat{h}_p(n)$ become biased [Spriet]. This problem is perhaps the single most important problem in feedback cancellation and unless other measures are taken to counteract the problem, the feedback cancellation solution in FIG. 3 will result in degraded or even useless performance.

FIG. 3*c* shows an audio processing system as in FIGS. 3*a* (and 3*b*), but wherein the processing of the Beamformer and the signal processing unit ($G(\omega,n)$) is performed in the frequency domain. An analysis filterbank (A-FB) is inserted in each of the microphone paths), i=1, 2, . . . , P, whereby the error corrected input signals $e_i(n)$, i=1, 2, . . . , P are converted to the time-frequency domain, each signal being represented by time dependent values in M frequency bands. A synthesis filterbank (S-FB) is inserted in the forward path after the signal processing unit ($G(\omega,n)$) to provide the output signal to the loudspeaker in the time domain. Other parts of the processing of the audio processing system may be performed fully or partially in the frequency domain, e.g. the feedback estimation (e.g. the adaptive algorithms of blocks Est.i, cf. FIG. 3*b*).

Figure 4:
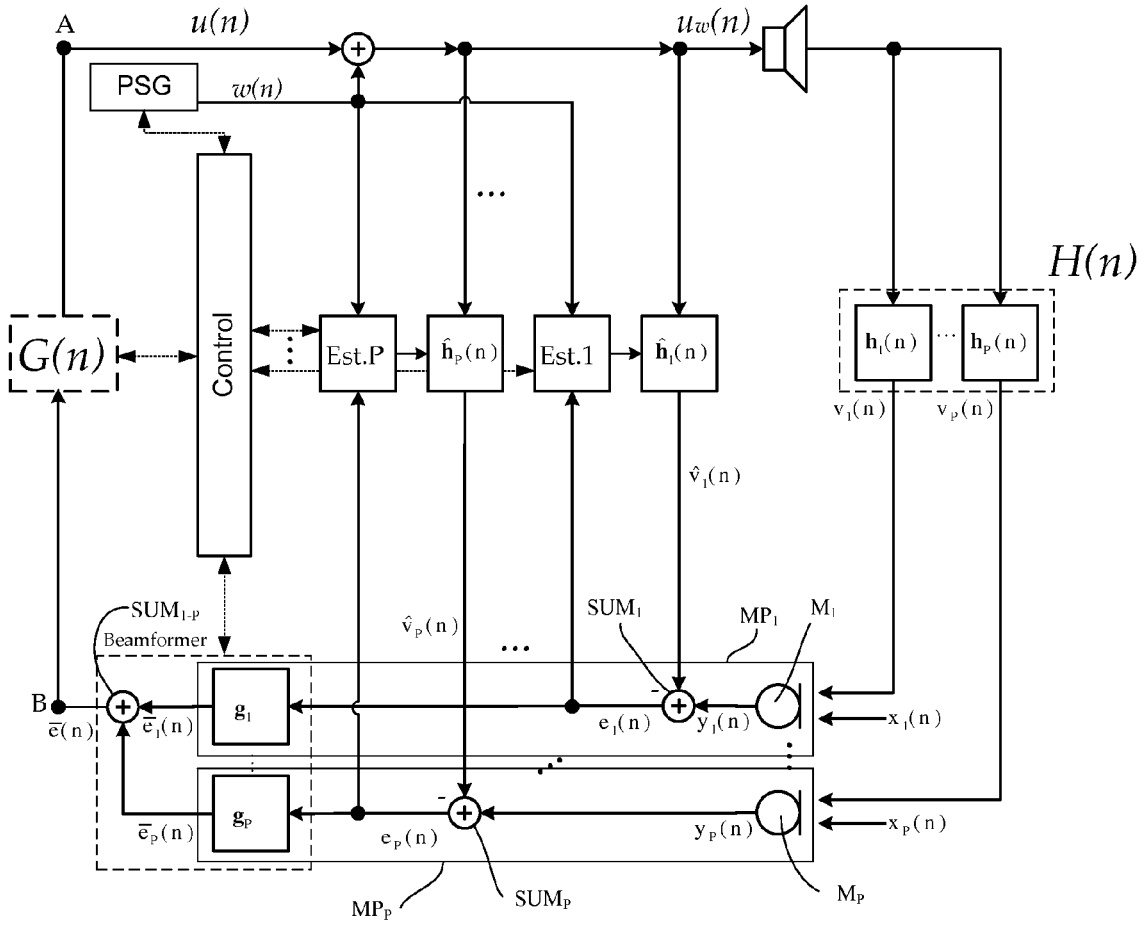
FIG. 4 shows an embodiment of an audio processing system comprising probe signal based feedback cancellation according to the present disclosure.

Unlike a traditional feedback cancellation system as depicted in FIG. 3*b*, we consider in this disclosure an audio processing system comprising a probe noise based system as e.g. shown in FIG. 4, where a so-called probe noise sequence w(n) (cf. unit PSG) is added (cf. SUM unit '+') to the loudspeaker signal u(n) to form the combined signal $u_w(n)$ which is played back to the user of the device via the loudspeaker. The estimation blocks Est.i, i=1, 2, . . . , P, receive inputs in the form of the probe signal w(n) and the respective error corrected input signal $e_i(n)$, i=1, 2, . . . , P. Adding the probe noise signal is a well-known solution to the correlation problem described above in relation to FIG. 3*b*. Specifically, when a probe noise sequence w(n) is added to the loudspeaker signal u(n), and w(n) is uncorrelated with the incoming signals $x_1(n)$, . . . , $x_p(n)$, a condition which can be satisfied in practice, then it can be shown that the estimates $\hat{h}_1(n)$, . . . , $\hat{h}_p(n)$ obtained from the configuration in FIG. 4 are unbiased.

The individual microphone paths $MP_i$, i=1, 2, . . . , P are enclosed by a rectangle with dotted outline. Each microphone path $MP_i$, i=1, 2, . . . , P comprise a microphone $M_1$, a sum unit (Y) denoted $SUM_i$ and a beamformer filter $g_i$, these components being operationally connected to each other (and in FIG. 4 connected in that order). The Beamformer is enclosed in a rectangle with dashed outline and comprises the P beamformer filters and a sum unit ('+') denoted $SUM_{1-P}$.for combining (e.g. adding) the P outputs of the beamformer filters $g_i$, i=1, 2, . . . , P.

Figure 5:
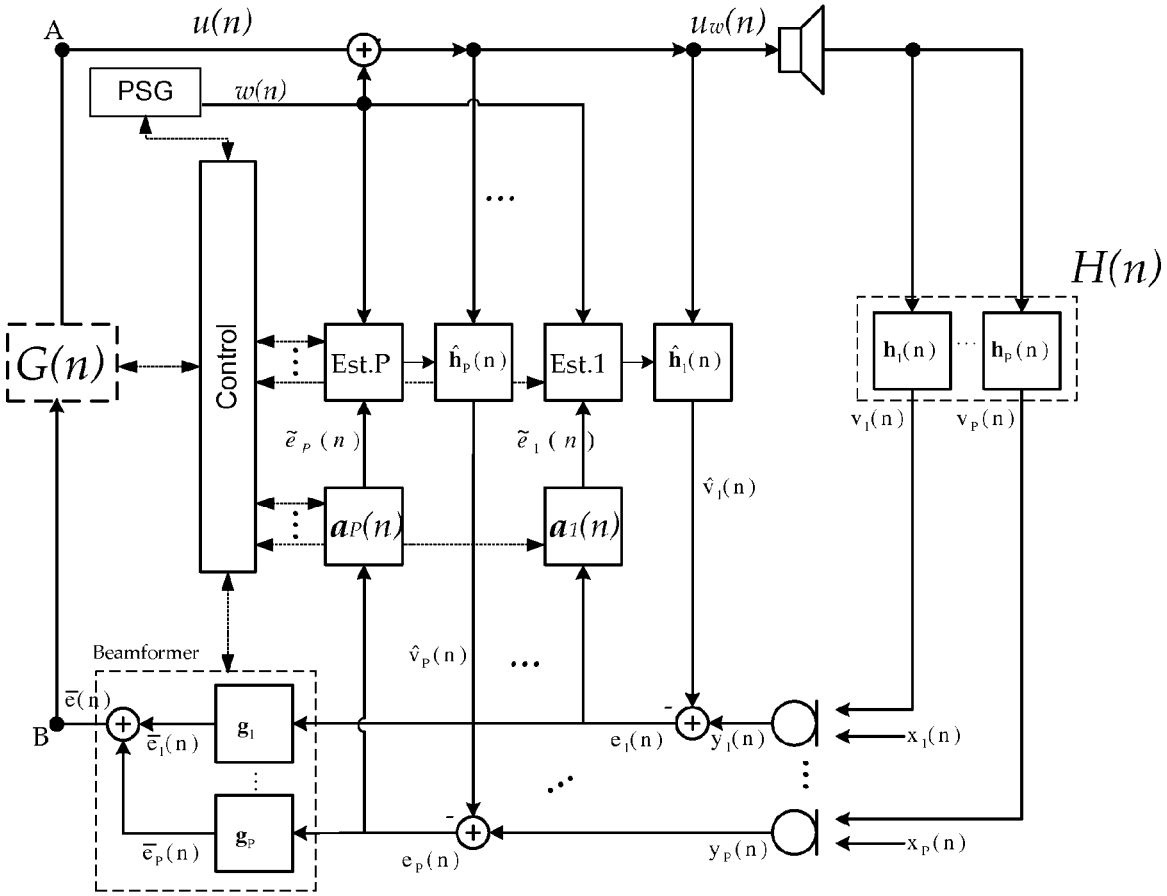
FIG. 5 shows an embodiment of an audio processing system comprising probe signal based feedback cancellation using enhancement filters $a_i(n)$ on the error signals On) according to the present disclosure.

Although the system in FIG. 4 leads to unbiased feedback path estimates, the unbiasedness comes at a price: when the system has to adapt to changes in the true feedback paths $h_i(n)$, i=1, . . . , P the system adapts rather slowly, such that relatively fast feedback path changes cannot be tracked accurately. This problem can be reduced by including so-called enhancement filters $a_i(n)$, either operating on the feedback compensated signals $e_i(n)$, i=1, . . . ,P as shown in FIG. 5, or including two sets of enhancement filters operating on both $e_i(n)$, i=1, . . . ,P and on the probe noise w(n) as in FIG. 6. The enhancement filters can then be chosen to have a transfer function of the form:

$$A(\omega) = 1 + \sum_{k=D}^{L_a-1} a(k)e^{-j\omega k}.$$

In order to ensure that the resulting feedback path estimates $\hat{h}_1(n)$, . . . , $\hat{h}_p(n)$ are unbiased, D should be chosen to satisfy $D>L_w+1$, where $L_w$ is the correlation time in samples of the added probe noise signal w(n), and L is the number of taps in the feedback path (dimension of the feedback path compensation filters $\hat{h}_i$), and $L_a$ is the dimension of the enhancement filter $A(\omega)$. For later use, we define the complex-valued spectral value $A_0(\omega)$ as the discrete Fourier transform of the sequence [0 . . . 0 a(D) a(D+1). . . a($L_a$−1)], evaluated at the angular frequency ω. In an embodiment, L=64 (samples). In an embodiment, $L_w$=64 (for white noise, $L_w$=0). In an embodiment, $L_a$=192. In an embodiment, D>64+64−1=127 ($L_a$ must be larger than D).

The method of the present disclosure as described in the following is e.g. implemented in control unit Control and/or in the signal processing unit G in FIGS. 4, 5 and 6. The control unit Control is in communication with relevant units of the embodiments in question, possibly including the enhancement filters $a_i$, the estimation units Est.i of the adaptive feedback estimation filters, the signal processing unit G(n), the probe signal generator PSG and the beamformer filters $g_i$. The Control unit and/or the signal processing unit G is e.g. adapted to determine an expression of an approximation of the square of the expected squared stationary loop gain $LG_{stat}(\omega,n)$, and an expression of the convergence or decay rate of the expected square of the stationary loop gain, $LG_{stat}(\omega,n)$, after an abrupt change in one or more system parameters, and to determine a system parameter sp(ω,n), from one of the expressions under the assumption of one or more other system parameters being fixed. This will be further explained in the following.

Figure 6:
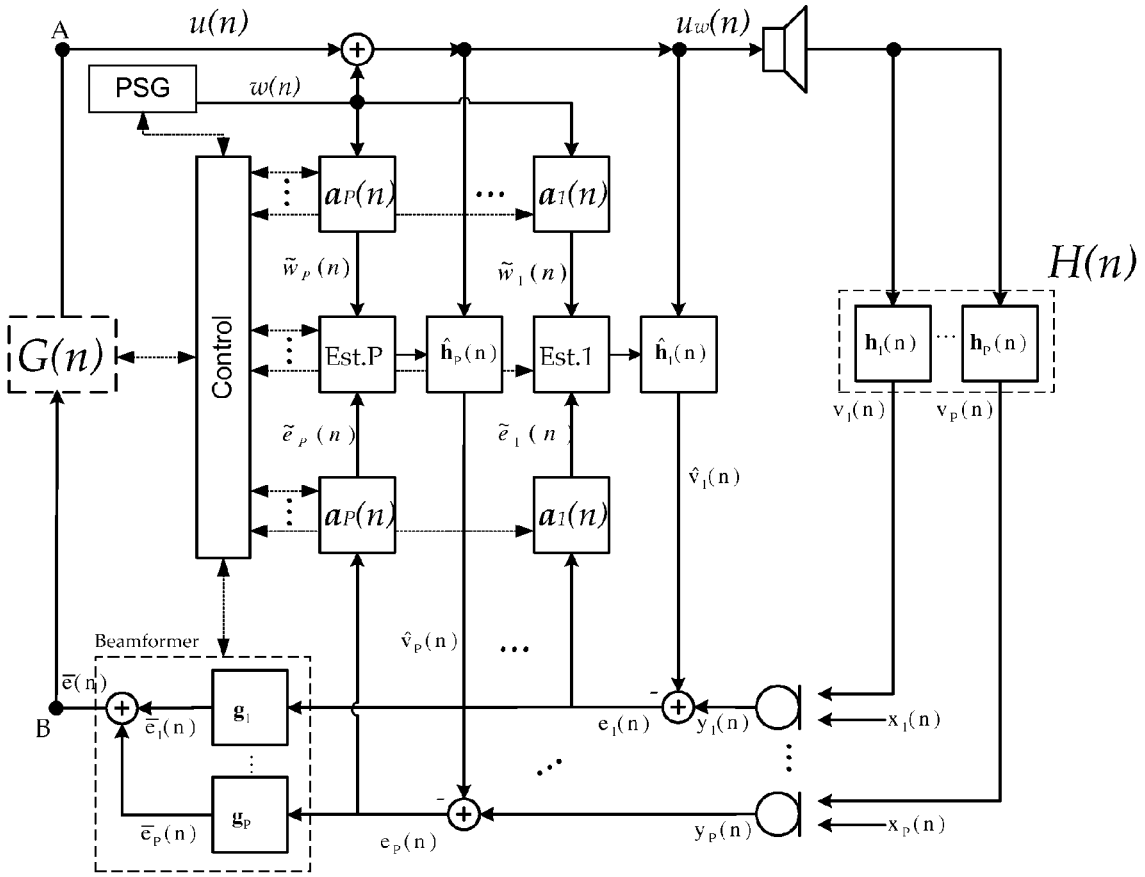
FIG. 6 shows an embodiment of an audio processing system comprising probe signal based feedback cancellation using enhancement filters $a_i(n)$ on both the error signals $e_i(n)$ and the probe noise signal w(n) according to the present disclosure.

The goal of this invention is to allow control of the LG in probe noise based DFC systems, including the traditional probe noise based system in FIG. 4, and the versions where one or two sets of enhancement filters have been included, FIG. 5 and FIG. 6, respectively, cf. e.g. EP 2 237 573 A1. More specifically, we show how system parameters such as forward gain G(n), enhancement filters $a_i(n)$, or the step length parameter μ(n) (defined below) used in the adaptive algorithm for updating the feedback path estimates $\hat{h}_i(n)$ should be chosen, as a function of time and frequency, for obtaining a certain desired behavior of the LG. The desired LG behavior may for example be characterized in terms of convergence rate, i.e., the speed with which the LG is reduced across time for a given system configuration, or the stationary LG, i.e., the LG that the system approaches when the system parameters are unchanged for sufficiently long.

Let us assume that the adaptive filter estimates are updated using the following update rule for the three configurations in FIGS. 4, 5, and 6, respectively $$\hat{h}_i(n)=(n-1)+\mu(n)w(n)e_i(n),\ i=1,\ldots,P,$$

$$\hat{h}_i(n)=\hat{h}_i(n-1)+\mu(n)w(n)\tilde{e}_i(n),\ i=1,\ldots,P,$$

and $$\hat{h}_i(n)=\hat{h}_i(n-1)+\mu(n)\tilde{w}_i(n),\ \tilde{e}_i(n),\ i=1,\ldots,P,$$

respectively.

In any practical system, the OLTF and LG is unknown (since the feedback path is unknown), but it can be estimated. An estimate of the LG is useful for hearing aid control algorithms in order to choose the proper parameters, program modes etc. to control for instance the adaptive feedback cancellation algorithm. In the following we present results from analytical derivations/approximations which describe the connection between the estimated LG and various control parameters in the hearing aids; the methodology for performing the derivations has been adopted from [Gunnarsson & Ljung]. We use this connection to propose methods for adjusting appropriate values of the control parameters in order to obtain a certain stationary LG or a certain convergence rate of the LG.

In the following, the step size p of the adaptive feedback path estimation algorithm is taken as an example of the use of the method. In a similar manner, other system parameters can be determined in order to achieve a desired behavior of the feedback cancellation algorithm.

For the update rules above, we now show expressions for the LG as a function of various system parameters.

Loop Gain Expressions—Probe Noise based system (FIG. 4)

For the system in FIG. 4, it can be shown that the following relation involving the expected squared stationary loop gain holds:

$$E[LG^2(\omega,n)] = G^2(n)L\frac{\mu(n)}{2}\sum_i\sum_j G_j^*(\omega)G_i(\omega)S_{x_{ij}}(\omega)\ \text{for}\ n\to\infty,$$

where E[·] is the statistical expectation operator, Lis the dimension of the feedback compensation filters $\hat{h}_i(n)$, i=1, . . . , P, $G_i(\omega)$ is the discrete Fourier transform of the impulse response of the ith beam former filter (which is assumed time invariant, for convenience), * denotes the complex conjugate, and $S_{x_{ij}}(\omega)$ is the (cross-) power spectral density of the signals $x_i(n)$ and $x_j(n)$ impinging on microphones i and j, respectively (i.e. $S_{x_{ij}}(\omega)=E[x_i(\omega,n)\ x_j^*(\omega,n)]$, where $x_j^*(\omega,n)$ is the complex conjugate of $x_j(\omega,n)$). For simplicity, we have assumed the true feedback paths $h_i(n)$, i=1, . . . , P to remain fixed across time. Time-varying feedback path variations can be taken into account, see, but the expression for the stationary loop gain becomes more complicated. The condition n→∞ simply means that the equation describes an asymptotic behavior. In practice, the equation can be accurate after as short time durations as 50 ms, which makes the equation of practical relevance.

Similarly, it can be shown that the convergence rate Δ (i.e., the decay rate of $E[LG^2(\omega,n)]$ after an abrupt change in system parameters) is expressed by:

$$\Delta=10\log_{10}\alpha[\text{dB/sample}],$$

or $$\Delta\approx f_s 10\log_{10}\alpha[\text{dB/s}],$$

where $$\alpha=1-2\mu S_w(\omega),$$

and where $f_s$ is the sample rate in Hz, μ is the step size of the adaptive feedback path estimation algorithm, and $S_w(\omega)$ is the power spectral density of the probe noise signal inserted in the forward path.

Using these expressions, it is simple to, e.g., find the constant step length parameter ,u to achieve a desired (expected) stationary LG or convergence rate. Specifically, if one wishes a stationary LG of LG(ω,n=∞), then the step length should be chosen as $$\mu=\frac{LG^2(\omega,n=\infty)}{G^2(n=\infty)}\frac{1}{L}\frac{2}{\sum_i\sum_j G_j^*(\omega)G_i(w)S_{x_{ij}}(\omega)}.$$

Thus, for example if the gain G(n) in the forward path increases by a factor of 2, then the step length μ must be reduced by a factor of 4 in order to maintain the same stationary loop gain.

Alternatively, if one wishes a convergence rate of Δ* at frequency ω, then the step length parameter must be chosen as $$\mu = \frac{1 - 10^{\Delta^*/10}}{2S_w(\omega)}.$$

The expressions above involve some system and signal related quantities, which may not be explicitly available in some applications, including hearing aids. In practice, these must be estimated from signals which are available. Specifically, the (cross-) power spectral density $S_x^{ij}(\omega)$ of the signals $x_1(n)$ and $x_j(n)$ impinging on microphones i and j cannot be observed directly, but can be estimated via the respective error signals $e_i(n)$ and $e_j(n)$ in FIG. 4. In other words $S_{xij}(\omega) \sim S_{eij}(\omega)$.

Loop Gain Expressions—Probe Noise Based System with One Enhancement Filter (FIG. 5)

For the configuration in FIG. 5. it can be shown that the stationary LG is related to the system parameters as follows $$E[LG^2(\omega, n)] = |A(\omega)|^2 G^2(n) L \frac{\mu(n)}{2} \sum_i \sum_j G_j^*(\omega) G_i(\omega) S_{x_{ij}}(\omega)$$

$$\text{for } n \to \infty,$$

where $|A(\omega)|$ is the magnitude response of the enhancement filter, and the rest of the parameters are as in the previous section.

It can also be shown that the convergence rate $\Delta$ is unchanged:

$$\Delta = 10 \log_{10} \alpha [\text{dB per iteration}],$$

where $$\alpha = 1 - 2\mu S_w(\omega).$$

With this, the value of the step length $\mu$ to achieve a desired stationary LG of $LG(\omega, n=\infty)$ is given by $$\mu = \frac{LG^2(\omega, n = \infty)}{G^2(n = \infty)} \frac{1}{L} \frac{1}{|A(\omega)|^2} \frac{2}{\sum_i \sum_j G_j^*(\omega) G_i(\omega) S_{x_{ij}}(\omega)}.$$

and to achieve a desired convergence rate of $\Delta^*$ at frequency $\omega$, the step length parameter $\mu$ must be chosen as $$\mu = \frac{1 - 10^{\Delta^*/10}}{2S_w(\omega)},$$

as before.

The (cross-) power spectral density $S_{xij}(\omega)$ of the signals $x_i(n)$ and $x_j(n)$, can be estimated by the respective error signals $e_i(n)$ and $e_i(n)$ in FIG. 1.

Loop Pain Expressions—Probe Noise Based System with Two Enhancement Filters (FIG. 6)

For the configuration in FIG. 6, the stationary LG is related to the system parameters as $$E[LG^2(\omega, n)] = |A(\omega)|^2 G^2(n) L \frac{\mu(n)}{2} \sum_i \sum_j G_j^*(\omega) G_i(\omega) S_{x_{ij}}(\omega) \text{ for } n \to \infty,$$

where the parameters are defined in the previous section.

The convergence rate $\Delta$ is given by:

$$\Delta = 10 \log_{10} \alpha [\text{dB per iteration}],$$

where $$\alpha = 1 - 2\mu S_w(\omega)(1 + |A_0(\omega)|^2).$$

With this, the value of the step length $\mu$ to achieve a desired stationary LG of $LG(\omega, n=\infty)$ is given by $$\mu = \frac{LG^2(\omega, n = \infty)}{G^2(n = \infty)} \frac{1}{L|A(\omega)|^2} \frac{2}{\sum_i \sum_j G_j^*(\omega) G_i(\omega) S_{x_{ij}}(\omega)},$$

and to achieve a desired convergence rate of $\Delta^*$ at frequency $\omega$, the step length parameter $\mu$ must be chosen as $$\mu = \frac{1 - 10^{\Delta^*/10}}{2S_w(\omega)(1 + A_0(\omega))},$$

As before, the only quantities which are not directly observable are the (cross-) power spectral densities $S_{x_{ij}}(\omega)$ of the signals $x_i(n)$ and $x_j(n)$, which can be estimated from the respective error signals $e_i(n)$ and $e_j(n)$ in FIG. 6.

Figure 7:
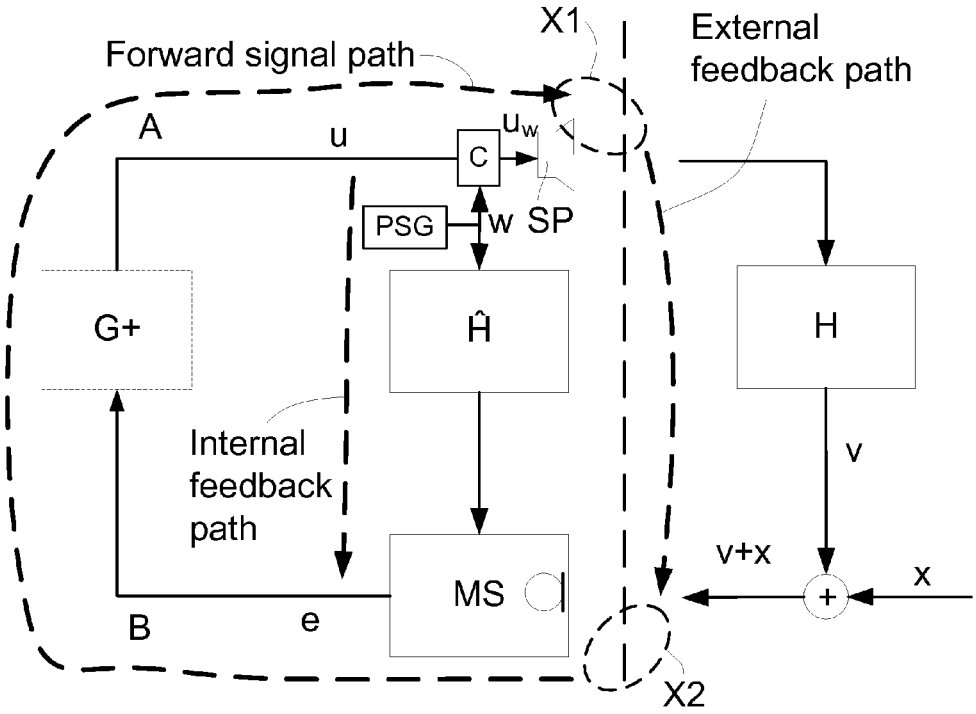
FIG. 7 shows a generalized view of an audio processing system according to the present disclosure, which e.g. may represent a public address system or a listening system, e.g. a hearing aid system.

Example with Definition of Gain Loop (FIG. 7):

FIG. 7 shows a generalized view of an audio processing system according to the present disclosure, which e.g. may represent a public address system or a listening system, here thought of as a hearing aid system.

The audio processing system (e.g. a hearing aid system) comprises an input transducer system (MS) adapted for converting an input sound signal to an electric input signal (possibly enhanced, e.g. comprising directional information), an output transducer (SP) for converting an electric output signal to an output sound signal and a signal processing unit (G+), electrically connecting the input transducer system (MS) and the output transducer (SP), and adapted for processing an input signal (e) and provide a processed output signal (u). An (unintended, external) acoustic feedback path (H) from the output transducer to the input transducer system is indicated to the right of the vertical dashed line. The hearing aid system further comprises an adaptive feedback estimation system (A) for estimating the acoustic feedback path and electrically connecting to the output transducer (SP) and the input transducer system (MS). The adaptive feedback estimation system (A) comprises an adaptive feedback cancellation algorithm, e.g. an LMS or NLMS or other adaptive algorithm, see [Haykin]. The input sound signal comprises the sum (v+x) of an unintended acoustic feedback signal v and a target signal x. In the embodiment of FIG. 7, the electric output signal u from the signal processing unit G+ is fed to a combination unit C (e.g. a SUM unit) where it is modified by a probe signal w from probe signal generator PSG, the resulting signal $u_w$ being fed to the output transducer SP. The probe signal is used as an input signal to the adaptive feedback estimation system $\hat{H}$ as well. Alternatively, the combination (e.g. the sum) of the probe signal w and output signal u from the signal processing unit G+ may be used as an input signal to the adaptive feedback estimation system $\hat{H}$. The time and frequency dependent output signal(s) $\hat{v}$ from the adaptive feedback estimation system $\hat{H}$ is intended to track the unintended acoustic feedback signal v. Preferably, the feedback estimate $\hat{v}$ is subtracted from the input signal (comprising target and feedback signals x+v), e.g. in summation unit(s) in the forward path of the system (e.g. in block MS as e.g. shown in FIG. 2), thereby ideally leaving the target signal x to be further processed in the signal processing unit (G+, or G(ω,n) in FIG. 2).

The input transducer system may e.g. be a microphone system (MS) comprising one or more microphones. The microphone system may e.g. also comprises a number of beamformer filters (e.g. one connected to each microphone) to provide directional microphone signals that may be combined to provide an enhanced microphone signal, which is fed to the signal processing unit for further signal processing (cf. e.g. FIG. 2).

A forward signal path between the input transducer system (MS) and the output transducer (SP) is defined by the signal processing unit (G+) and electric connections (and possible further components) there between (cf. dashed arrow Forward signal path). An internal feedback path is defined by the feedback estimation system ($H_{est}$) electrically connecting to the output transducer and the input transducer system (cf. dashed arrow Internal feedback path). An external feedback path is defined from the output of the output transducer (SP) to the input of the input transducer system (MS), possibly comprising several different sub-paths from the output transducer (SP) to individual input transducers of the input transducer system (MS) (cf. dashed arrow External feedback path). The forward signal path, the external and internal feedback paths together define a gain loop. The dashed elliptic items denoted X1 and X2 respectively and tying the external feedback path and the forward signal path together is intended to indicate that the actual interface between the two may be different in different applications. One or more components or parts of components in the audio processing system may be included in either of the two paths depending on the practical implementation, e.g. input/output transducers, possible A/D or D/A-converters, time->frequency or frequency->time converters, etc.

The adaptive feedback estimation system comprises e.g. an adaptive filter. Adaptive filters in general are e.g. described in [Haykin]. The adaptive feedback estimation system is e.g. used to provide an improved estimate of a target input signal by subtracting the estimate from the input signal comprising target as well as feedback signal. The feedback estimate may be based on the addition of probe signals of known characteristics to the output signal. Adaptive feedback cancellation systems are well known in the art and e.g. described in U.S. Pat. No. 5,680,467 (GN Danavox), in US 2007/172080 A1 (Philips), and in WO 2007/125132 A2 (Phonak).

The adaptive feedback cancellation algorithm used in the adaptive filter may be of any appropriate type, e.g. LMS, NLMS, RLS or be based on Kalman filtering. Such algorithms are e.g. described in [Haykin]. Least-Mean-Square Adaptive Filters (LMS, NLMS, etc.) are e.g. described in chapter 5, 6 of [Haykin]. Recursive Least-Square Adaptive Filters (RLS) are e.g. described in chapter 7 of [Haykin]. Kalman filters are e.g. described in chapter 8 of [Haykin].

The directional microphone system is e.g. adapted to separate two or more acoustic sources in the local environment of the user wearing the listening device. In an embodiment, the directional microphone system is adapted to detect (such as adaptively detect) from which direction a particular part of the microphone signal originates. Such systems can be implemented in various different ways as e.g. described in U.S. Pat. No. 5,473,701 or in WO 99/09786 A1 or in EP 2 088 802 A1 An exemplary textbook describing multi-microphone systems is [Gay & Benesty], chapter 10, Superdirectional Microphone Arrays.

The signal processing unit (G+) is e.g. adapted to provide a frequency dependent gain according to a user's particular needs. It may be adapted to perform other processing tasks e.g. aiming at enhancing the signal presented to the user, e.g. compression, noise reduction, etc., including the generation of a probe signal intended for improving the feedback estimate.

Other components (or functions) may be present than the ones shown in the figures. The forward signal path will typically comprise analogue to digital (ND) and digital to analogue (D/A) converters, time to time-frequency and time-frequency to time converters, which may or may not be integrated with, respectively, the input and output transducers. Similarly, the order of the components may be different to the one shown in the present embodiments. In an embodiment, the subtraction units ('+') and the beamformer filters $g_i$ of the microphone paths are reversed compared to the embodiments shown in the present embodiments.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

[Haykin] S. Haykin, Adaptive filter theory (Fourth Edition), Prentice Hall, 2001.

[Gunnarsson & Ljung] S. Gunnarson, L. Ljung. Frequency Domain Tracking Characteristics of Adaptive Algorithms, IEEE Transactions on Acoustics, Speech, and Signal Processing, Vol. 37, No. 7, July 1989, pp. 1072-1089.

[Spriet] A. Spriet et al., Adaptive feedback cancellation in hearing aids, Journal of the Franklin Institute, 2006, pp. 545-573.

[Bitzer & Simmer] J. Bitzer and K. U. Simmer, "Superdirective microphone arrays," in Microphone Arrays, Brandstein and Ward, Eds. Springer, 2001, ch. 2, pp. 19-38.

[Schaub] Arthur Schaub, Digital hearing Aids, Thieme Medical. Pub., 2008.

[Gay & Benesty], Steven L. Gay, Jacob Benesty (Editors), Acoustic Signal Processing for Telecommunication, 1. Edition, Springer-Verlag, 2000.

EP2237573A1 (OTICON) Jun. 10, 2010

U.S. Pat. No. 5,473,701 (ATT) May 12, 1995

WO 99/09786 A1 (PHONAK) Feb. 25, 1999

EP 2 088 802 A1 (OTICON) Dec. 8, 2009

U.S. Pat. No. 5,680,467 (GN DANAVOX) Oct. 21, 1997

US 2007/172080 A1 (PHILIPS) Jul. 26, 2007

WO 2007/125132 A2 (PHONAK) Aug. 11, 2007

[Dillon] Harvey Dillon, Hearing Aids, Thieme, New York-Stuttgart, 2001.

The invention claimed is:

1. A method of determining a system parameter sp in a gain loop of an audio processing system, the audio processing system comprising a) a microphone system comprising a1) a number P of electric microphone paths, each microphone path $MP_i$, i=1, 2, . . . , P, providing a processed microphone signal, each microphone path comprising a1.1) a microphone $M_i$ for converting an input sound comprising a target signal $x_i$ to an electric signal $y_i$;

a1.2) a unit $SUM_i$ for providing a summation of a signal of the microphone path $MP_i$ and a further signal providing error signal $e_i$;

a1.3) a beamformer filter $g_i$ for performing spatial filtering of an input signal of the microphone path $MP_i$ to obtain a noise-reduced signal $\bar{e}_i$;

wherein the microphone $M_i$, the summation unit $SUM_i$ and the beamformer filter $g_i$ are operationally connected in series to provide said processed microphone signal equal to said noise-reduced signal $\bar{e}_i$ or a signal originating therefrom; and a2) a summation unit $SUM_{1-P}$ connected to the output of the microphone paths i=1, 2, . . . , P, to perform a summation of said processed microphone signals thereby providing a resulting input signal;

b) a signal processing unit for applying a, time-varying, frequency dependent gain G to said resulting input signal or a signal originating therefrom to a processed signal;

c) a probe signal generator for inserting a probe signal w in the forward path, the probe signal exhibiting predefined properties and having a short-time power spectral density $S_w(\omega)$;

d) a loudspeaker unit for converting said processed signal or a signal originating therefrom u to an output sound;

said microphone system, said signal processing unit and said loudspeaker unit forming part of a forward signal path;

e) an adaptive feedback estimation system comprising a number of internal feedback paths $IFBP_i$, i=1, 2, . . . , P, for generating an estimate of a number P of unintended feedback paths, each unintended feedback path at least comprising an external feedback path from the output of the loudspeaker unit to the input of a microphone $M_i$, i=1, 2, . . . , P, and each internal feedback path comprising a feedback estimation unit comprising a feedback compensation filter of length L samples for providing an estimated impulse response $\hat{h}_i$ of the $i^{th}$ unintended feedback path, i=1, 2, . . . , P, using an adaptive feedback estimation algorithm, the estimated impulse response $\hat{h}_i$ being subtracted from a signal from the $i^{th}$ microphone path $MP_i$ in respective of said summation units $SUM_i$ of said microphone system to provide said error signals $e_i$, i=1, 2, . . . , P, the adaptive algorithm comprising an adaptation parameter μ for controlling an adaptation speed of the adaptive algorithm relating a current feedback estimate to a previous feedback estimate, wherein the internal feedback paths $IFBP_i$, i=1, 2, . . . , P of the adaptive feedback estimation system further comprises an enhancement filter ($a_i(n)$) operating on the feedback compensated signals $e_i$, i=1, 2, . . . , P, of the forward path and being adapted to retrieve said predefined properties of said probe signal and providing an enhanced error signal $\tilde{e}_i$ connected to the feedback estimation unit of the $i^{th}$ internal feedback path $IFBP_i$;

the forward signal path, together with said external and internal feedback paths defining said gain loop, the method comprising S1a) determining an expression of an approximation of the expected square of the stationary loop gain, $LG_{stat}(\omega,n)$, where ω is normalized angular frequency, and n is a discrete time index, the expression being dependent on said frequency dependent gain G, a dimension L of said feedback compensation filters, said adaptation parameter μ for the adaptive algorithm and an expression $$|A(\omega)|^2 \sum_i \sum_j G_j^*(\omega) G_i(\omega) S_{x_{ij}}(\omega)$$

wherein |A(ω)| is the magnitude response of the enhancement filter, $G_i(\omega)$ and $G_j(\omega)$ are the frequency transform of the $i^{th}$ and $j^{th}$ beamform filters, respectively, * denotes the complex conjugate, and $S_{xij}(\omega)$ is the cross-power spectral density of the signals $x_i(n)$ and $x_j(n)$ picked up by microphones i and j respectively, where i=1, 2, . . . , P and j=1, 2, . . . , P, and wherein the expression $LG_{stat}(\omega,n)$ for stationary loop gain represents an asymptotic value for n→∞; or S1b) determining an expression of the convergence or decay rate of the expected square of the stationary loop gain, $LG_{stat}(\omega,n)$, after an abrupt change in one or more system parameters, the expression being dependent on said adaptation parameter μ for the adaptive algorithm and the power spectral density $S_w(\omega)$ of the probe signal;

S2) determining a system parameter sp, from one of said expressions under the assumption that other system parameters are fixed.

2. A method according to claim 1, wherein the enhancement filters $a_i$, i=1, 2, . . . , P, have a transfer function of the form:

$$A(\omega) = 1 + \sum_{k=D}^{L_a-1} a(k) e^{-j\omega k}$$

where $L_a$ is the dimension of the enhancement filter, D is chosen to satisfy D>0, k is a sample index, and a(k) the filter coefficients, and wherein in step S1a) said expression of an approximation of the expected square of the stationary loop gain, $LG_{stat}(\omega,n)$, is further dependent on the square of the magnitude of the transfer function A(ω) of the enhancement filter.

3. A method according to claim 1, wherein the internal feedback paths $IFBP_i$, i=1, 2, . . . , P, of the adaptive feedback estimation system further comprises an enhancement filter $a_i$ operating on the probe signal w(n) and being adapted to retrieve said predefined properties of said probe signal and providing an enhanced probe signal $\tilde{w}_i(n)$ connected to the feedback estimation unit of the $i^{th}$ internal feedback path $IFBP_i$.

4. A method according to claim 3, wherein the enhancement filters $a_i$, i=1, 2, . . . , P, have a transfer function of the form:

$$A(\omega) = 1 + \sum_{k=D}^{L_a-1} a(k) e^{-j\omega k}$$

where $L_a$ is the dimension of the enhancement filter, D is chosen to satisfy D>0, and k is a sample index, and a(k) the filter coefficients, and wherein in step S1a) said expression of an approximation of the expected square of the stationary loop gain, $LG_{stat}(\omega,n)$, is further dependent on the square of the magnitude of the transfer function A(ω) of the enhancement filter; and in step S1b) said expression of the convergence or decay rate of the expected square of the stationary loop gain, $LG_{stat}(\omega,n)$, is further dependent on $A_0(\omega)$ as the discrete Fourier transform of the sequence [0 . . . 0 a(D) a(D+1) . . . a($L_a$−1)], evaluated at the angular frequency ω, where the dimension of the sequence is [1, $L_a$].

5. A method according to claim 3, wherein said adaptive feedback estimation algorithm is $$\tilde{h}_i(n)=\tilde{h}_i(n-1)+\mu(n)\tilde{w}_i(n)\tilde{e}_i(n),\ i=1,\ldots,P,$$

where $\tilde{h}_i$ is the estimated impulse response of the $i^{th}$ unintended feedback path, μ is the adaptation parameter, w the probe signal, $\tilde{w}_1(n)$ the enhanced probe signal, n a time instance, and i=1, 2, . . . , P. where the dimension of the sequence is [1, $L_a$].

6. A method according to claim 1 wherein said adaptive feedback estimation algorithm is $$\hat{h}_i(n)=\hat{h}_i(n-1)+\mu(n)w(n)e_i(n),\ i=1,\ldots,P,$$

where $\hat{h}_i$ is the estimated impulse response of the $i^{th}$ unintended feedback path, μ is the adaptation parameter, w the probe signal and $e_i$ the error signal of the forward path, n a time instance, and i=1, 2, . . . , P.

7. A method according to claim 1, wherein said adaptive feedback estimation algorithm is $$\hat{h}_i(n)=\hat{h}_i(n-1)+\mu(n)w(n)\tilde{e}_i(n),\ i=1,\ldots,P,$$

where $\hat{h}_i$ is the estimated impulse response of the $i^{th}$ unintended feedback path, μ is the adaptation parameter, w the probe signal, $\tilde{e}_i$ the enhanced error signal, n a time instance, and i=1, 2, . . . , P.

8. A method according to claim 1 wherein the cross-power spectral density $S_{xij}(\omega)$ of the signals $x_i(n)$ and $x_j(n)$ picked up by microphones i and j, respectively, is estimated by the cross-power spectral density of the respective error signals $e_i(n)$ and $e_j(n)$.

9. A method according to claim 1 wherein the asymptotic value for n→∞ of the expression for stationary loop gain $LG_{stat}(\omega,n)$ is to be reached after less than 500 ms.

10. A method according to claim 1 wherein the system parameter sp determined in step S2 under the assumption of one or more other system parameters being fixed at desired values is the adaptation parameter μ(n) of the adaptive algorithm or the gain G(n) of the signal processing unit.

11. A method according to claim 1 wherein the one or more other system parameters being fixed at a desired value in step S2 comprise one or more of the stationary loop gain $LG_{stat}(\omega,n)$ and the adaptation rate Δ(ω) at a given angular frequency ω.

12. A method according to claim 1 wherein a predetermined desired value of stationary loop gain $LG_{stat}(\omega,n)$ at a given angular frequency ω is used in step S1a to determine a corresponding value of the adaptation parameter μ of the adaptive algorithm at a given point in time and at the given angular frequency ω.

13. A method according to claim 1 wherein a predetermined desired value Δ* of the convergence rated of the expected square of the stationary loop gain $LG_{stat}(\omega,n)$ at a given angular frequency ω is used in step S1b to determine a corresponding value of the adaptation parameter μ of the adaptive algorithm at a given point in time and at the given angular frequency ω.

14. A method according to claim 1 wherein an angular frequency ω at which the system parameter sp is determined in step S2 is chosen as a frequency where stationary loop gain $LG_{stat}(\omega,n)$ is maximum or larger than a predefined value.

15. A method according to claim 1 wherein an angular frequency ω at which the system parameter sp is determined in step S2 is chosen as a frequency where instantaneous loop gain $LG_{stat}(\omega,n)$ is expected to be maximum or larger than a predefined value.

16. A method according to claim 1 wherein an angular frequency ω at which the system parameter sp is determined in step S2 is chosen as a frequency where the gain G(n) of the signal processing unit is highest, or where the gain G(n) of the signal processing unit has experienced the largest recent increase.

17. A data processing system comprising a processor and program code means for causing the processor to perform the steps of the method according to claim 1.

18. An audio processing system, comprising:

a) a microphone system comprising a1) a number P of electric microphone paths, each microphone path $MP_i$, i=1, 2, . . . , P, providing a processed microphone signal, each microphone path comprising a1.1) a microphone $M_i$ for converting an input sound comprising a target signal $x_i$ to an electric signal $y_i$;

a1.2) a unit $SUM_i$ for providing a summation of a signal of the microphone path $MP_i$ and a further signal providing error signal $e_i$;

a1.3) a beamformer filter $g_i$ for performing spatial filtering of an input signal of the microphone path $MP_i$ to obtain a noise-reduced signal $\bar{e}_i$;

wherein the microphone $M_i$, the summation unit $SUM_i$ and the beamformer filter $g_i$ are operationally connected in series to provide said processed microphone signal equal to said noise-reduced signal $\bar{e}_i$ or a signal originating therefrom; and a2) a summation unit $SUM_{1-P}$ connected to the output of the microphone paths i=1, 2, . . . , P, to perform a summation of said processed microphone signals thereby providing a resulting input signal;

b) a signal processing unit for applying a frequency dependent gain G to said resulting input signal or a signal originating therefrom to a processed signal;

c) a probe signal generator for inserting a probe signal w in the forward path, the probe signal exhibiting predefined properties and having a power spectral density $S_w(\omega)$;

d) a loudspeaker unit for converting said processed signal or a signal originating therefrom u to an output sound;

said microphone system, said signal processing unit and said loudspeaker unit forming part of a forward signal path; and e) an adaptive feedback estimation system comprising a number of internal feedback paths $IFBP_i$, i=1, 2, . . . , P, for generating an estimate of a number P of unintended feedback paths, each unintended feedback path at least comprising an external feedback path from the output of the loudspeaker unit to the input of a microphone $M_i$, i=1, 2, . . . , P, and each internal feedback path comprising a feedback estimation unit comprising a feedback compensation filter of length L for providing an estimated impulse response $\hat{h}_i$ of the $i^{th}$ unintended feedback path, i=1, 2, . . . , P, using an adaptive feedback estimation algorithm, the estimated impulse response $\hat{h}_i$ being subtracted from a signal from the $i^{th}$ microphone path $MP_i$ in respective of said summation units $SUM_i$ of said microphone system to provide said error signals $e_i$, i=1, 2, . . . , P, the adaptive algorithm comprising an adaptation parameter μ for controlling an adaptation speed of the adaptive algorithm relating a current feedback estimate to a previous feedback estimate, wherein the internal feedback paths $IFBP_i$, i=1, 2, . . ., P of the adaptive feedback estimation system further comprises an enhancement filter ($a_i(n)$) operating on the feedback compensated signals $e_i$, i=1, 2, . . ., P, of the forward path and being adapted to retrieve said predefined properties of said probe signal and providing an enhanced error signal $\tilde{e}_i$ connected to the feedback estimation unit of the $i^{th}$ internal feedback path $IFBP_i$;

the forward signal path, together with said external and internal feedback paths defining said gain loop, the audio processing system further comprising a control unit adapted to perform the steps of the method of claim 1.

19. A non-transitory tangible computer-readable medium storing a computer program comprising program code means for causing a data processing system to perform the steps of the method of claim 1, when said computer program is executed on the data processing system.

* * * * *